United States Patent [19]

Beckley et al.

[11] Patent Number: 4,766,840

[45] Date of Patent: Aug. 30, 1988

[54] PAPER COATING MACHINE

[75] Inventors: Robert A. Beckley; Harold D. Stroder, both of Mount Vernon, Ill.

[73] Assignee: World Color Press, Inc., Effingham, Ill.

[21] Appl. No.: 3,123

[22] Filed: Jan. 14, 1987

[51] Int. Cl.[4] ..... B05C 1/16; B05C 11/00

[52] U.S. Cl. ..... 118/46; 118/67; 118/68; 118/69; 118/211; 118/249; 118/262

[58] Field of Search ..... 118/46, 211, 262, 68, 118/249, 67, 69; 101/350, DIG. 14

[56] References Cited

U.S. PATENT DOCUMENTS

| | | | |
|---|---|---|---|
| 3,283,741 | 11/1966 | Brodie | 118/262 |
| 4,270,483 | 6/1981 | Butler et al. | 118/262 X |
| 4,399,767 | 8/1983 | Simeth | 118/46 |
| 4,524,712 | 6/1985 | Ito | 118/46 |
| 4,615,293 | 10/1986 | Jahn | 118/46 |

*Primary Examiner*—Evan Lawrence

*Attorney, Agent, or Firm*—Gravely, Lieder & Woodruff

[57] ABSTRACT

A highly compact machine for applying an attractive protective coating to a paper web that passes through a printing press is located between the last press stand and the dryer of the printing press, and to enable the machine to receive the web, the printing press is provided with an apparatus for directing the web back to the print stands and the machine after the web passes through the dryer. The machine includes upper and lower blanket cylinders, a plate cylinder contacting the lower blanket cylinder, and an oscillating cylinder below the plate cylinder. In addition the coating machine includes a pan containing a coating fluid and a pan roller, the surface of which rotates through the fluid in the pan to lift it out of the pan. A metering roller revolves close to the pan roller to remove excess fluid from the pan roller which thereupon transfers the fluid to a form roller. That form roller runs against the oscillating cylinder and transfers the fluid to the oscillating cylinder. Another form roller contacts both the oscillating cylinder and the plate cylinder, and transfers the fluid to the plate cylinder. The plate cylinder delivers the fluid to the lower blanket cylinder which in turn applies it to the web. The plate cylinder carries a cylindrical plate which is normally continuous, but may be left with a cutout or void so that a small portion of the web is left uncoated with each revolution of the blanket cylinder.

24 Claims, 4 Drawing Sheets

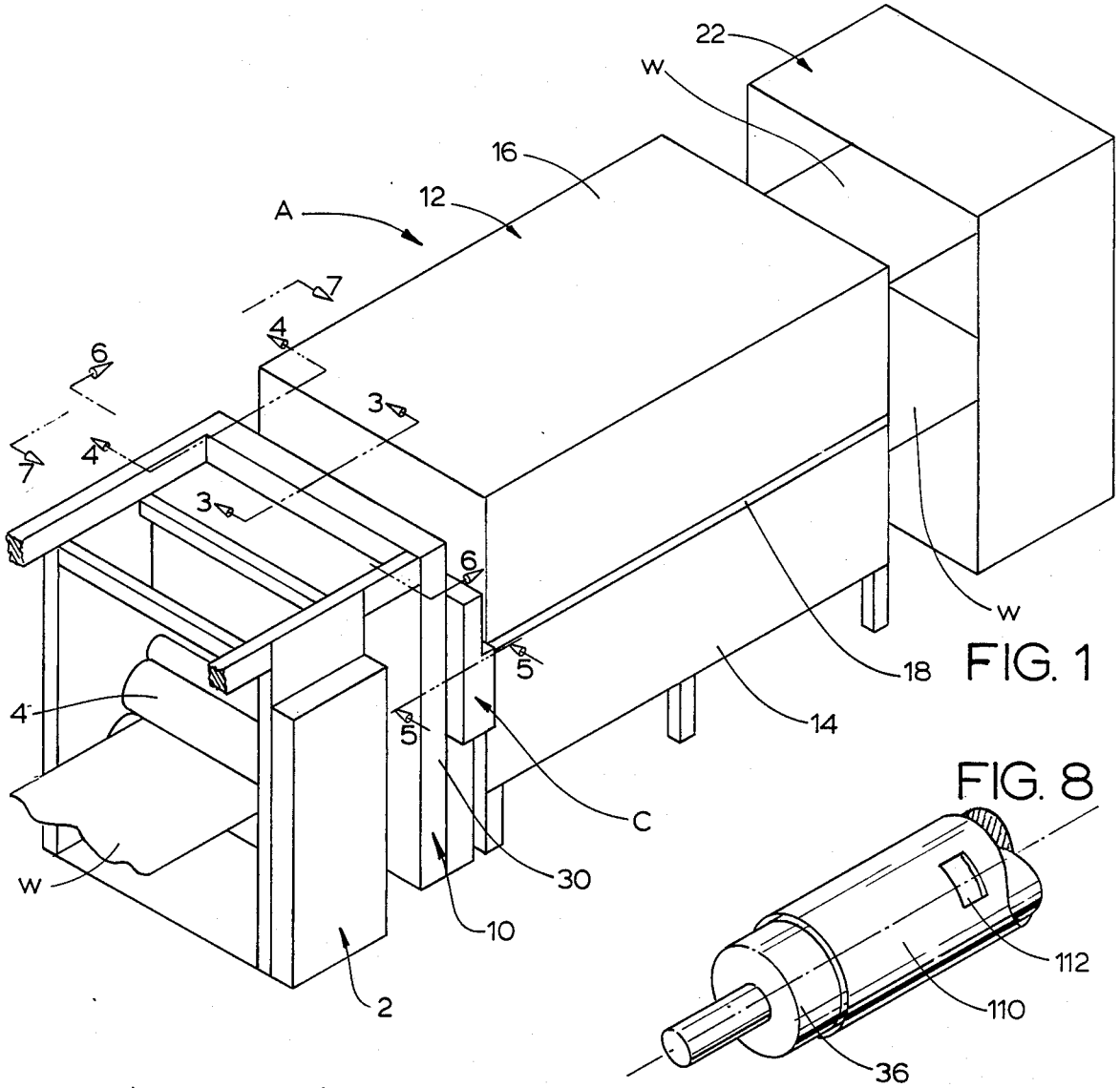
FIG. 1
FIG. 8
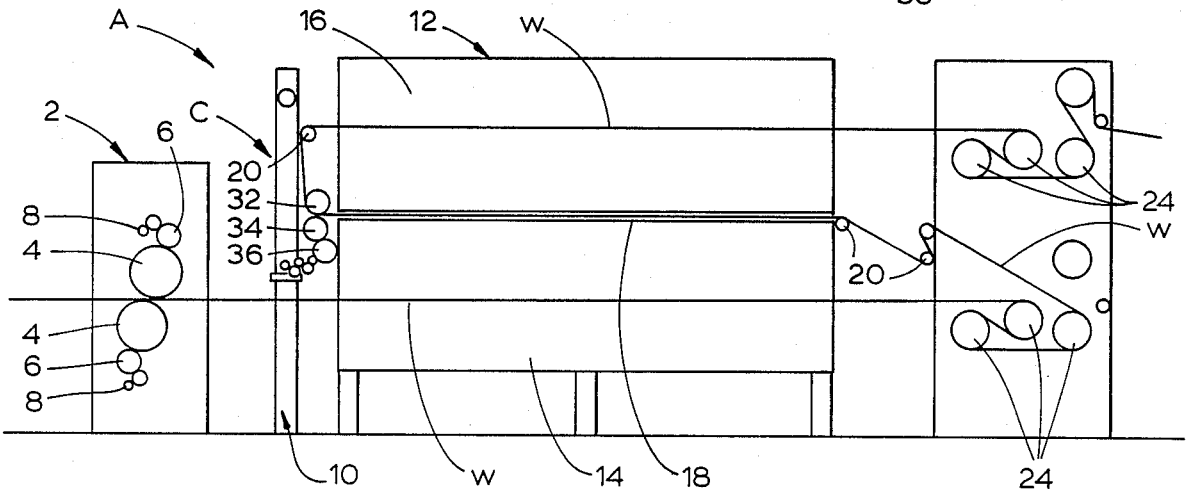
FIG. 2

PAPER COATING MACHINE

BACKGROUND OF THE INVENTION

This invention relates in general to printing and more particularly to a machine for applying coatings to printed webs in a printing press.

The cover and pages of a typical high quality magazine are usually printed on a four color offset printing press in which the four colors are applied successively to webs of paper that are run through the press at high speed. After emerging from the press, each web is severed and folded to form individual signatures, and these signatures are then loaded into a binding machine where they are with other signatures combined into the individual copies of the magazine. The typical four color printing press has a separate print stand for each color, and these stands are aligned and synchronized with each other such that a single web passing through them acquires a succession of impressions which combine to produce a four color print. In addition to the printing stands, the typical printing press has a dryer into which the web passes upon emerging from the last printing stand, and within this dryer the web is heated to volitilze the solvents within the ink. Even so, the printed impression will smear while the web remains hot, so many presses have chill roll stands beyond their dryers to cool the web and thereby render the full color printed impressions fast. Some sort of slitting and stacking machine is usually located beyond the chill roll stand to sever the webs and fold the severed segments in order to produce individual signatures which are thereafter stacked.

Certain portions of a magazine encounter more abuse than others, and perhaps no portion encounters more than the cover. For example, magazines are often arranged in bundles with one magazine stacked on top of another. During shipment the covers of these magazines shift or slide relative to each other, and this movement may partially obliterate the printed impression. Yet the cover is the portion of the magazine which the reader or potential purchaser first observes, and for this reason publishers put a great deal of thought and effort into preparing covers. Obviously, they want the covers of their publications to be attractive. To this end, printers on occasion apply a varnish or some other coating to the covers of the magazines that they print. This varnish, being considerably harder than the paper over which it extends, protects the printed impression, and further imparts a glossing texture to the cover so as to enhance its appearance.

Some printers engage outside contractors to apply the varnish, but this presents still another step in an already complex procedure and as such delays the production and significantly increases the cost. Others apply the varnish at the printing presses, but heretofore no truly satisfactory machines have been available for this procedure. Some coating machines of current construction employ the gravuer principle in that the coating is transferred directly from a plate cylinder to the web. Often the coating is not uniform and somewhat blemished. Moreover, this type of transfer does not lend itself to spot coating, that is leaving some areas of the cover free of the coating so that additional material, such as a subscribers' name and address or perhaps the price, may be subsequently printed on the publication. Moreover conventional coating machines occupy considerable space, usually at the end of a press beyond the chill roll stand, but space is usually at a premium in printing plants. Some coating machines of current construction fit on the actual press, but these machines apply the coating directly over the wet ink. This detracts from the quality of the printed impression, and to a measure counteracts the effects of the glossy texture. Others, are mounted beyond the press where they occupy considerable floor space that could be put to other uses. These machines rely on ultraviolet light from an ultraviolet source that is within the machine itself to dry the coating.

SUMMARY OF THE INVENTION

The present invention resides in at least one print stand and a dryer through which a web passes in that order, with a printed impression being applied to the web at the print stand and the ink of that impression being dried in the dryer. In addition the invention includes means for directing the web, after it passes through the dryer, back toward the print stand and a coating unit interposed between the print stand and the dryer for receiving the web and applying a coating fluid to it. The coating unit includes a blanket roller over which the web passes and means for supplying the coating fluid to the blanket roller.

DESCRIPTION OF THE DRAWINGS

In the accompanying drawings which form part of the specification and wherein like numerals and letters refer to like parts wherever they occur.

FIG. 1 is a perspective view of a printing press provided with a coating unit constructed in accordance with and embodying the present invention;

FIG. 2 is a schematic elevational view of the printing press showing the print stand, the coating unit, the dryer, and the chill stand;

FIG. 8 is a fragmentary perspective view of the plate cylinder provided with a plate having a cutout in it.

DETAILED DESCRIPTION

Figure 3:
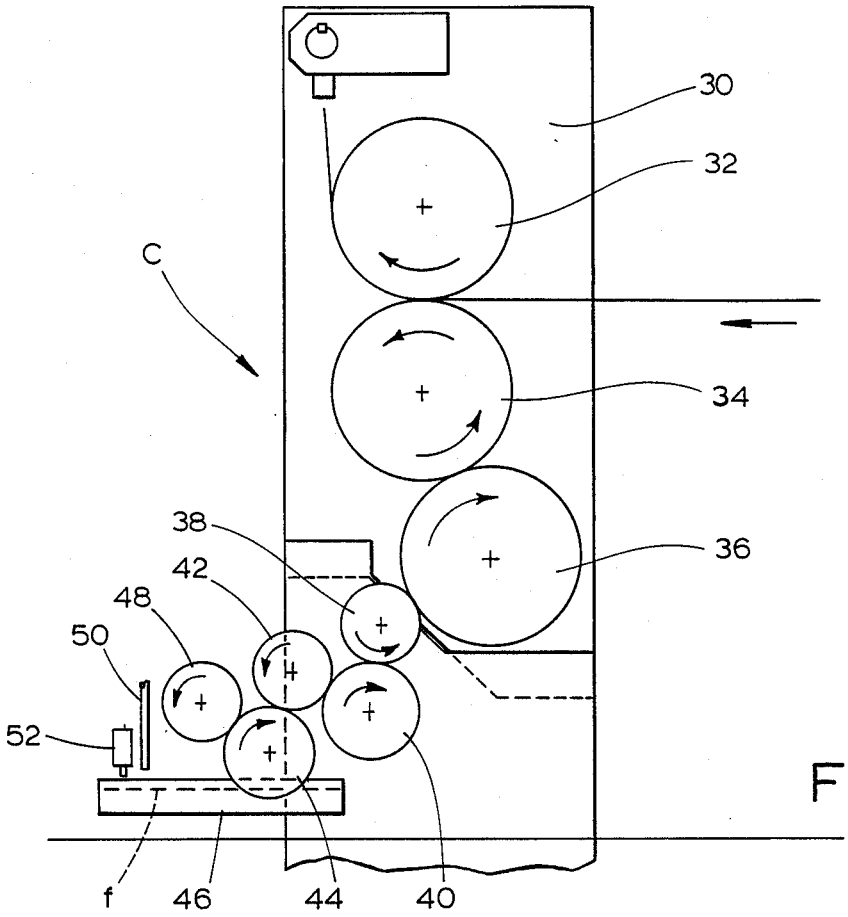
FIG. 3 is a sectional view of the coating unit taken along line 3—3 of FIG. 1 and showing the various revolving cylinders and rollers of the coating unit.

Referring now to the drawings, a printing press A (FIGS. 1 & 2) includes several offset printing stands 2 arranged in succession so that a single web w extends through each of them along a web travel line. Inasmuch as the press A operates on the offset principle, each press stand 2 has a pair of blanket cylinders 4 which come together along the web travel line t where the web w passes between the cylinders 4. Indeed, it is at this location that the printed impression for the color to which the press stand 2 is dedicated is applied to the web w. Each blanket cylinder 4 runs against a plate cylinder 6 which carries a cylindrical plate that is etched to conform to the image desired for the particular color to which the press stand 2 is dedicated. The plate cylinder 6 runs against an ink roller 8 which carries the ink of the color to which the press stand is dedicated and also a fountain solution which is essentially water. The ink and fountain solution separate on the etched plate of the plate cylinder 6, the former going to the etched areas and the latter to the blank areas. Of course, the plate upon further rotation of the plate cylinder 6 applies the ink in its etched area to the blanket cylinder 4 which in turn transfers it to the web w in the form of a printed impression.

Immediately beyond the last print stand 2 is a diverting stand 10 (FIGS. 1 & 2) which customarily carries rollers which are used to direct the web w from one level to another, and this increases the versatility of the press. For example, it is not uncommon for a press to have eight press stands 2 arranged one after the other, and when a press of this character is used for full color printing, two webs are generally run with the printed impression being applied to one web at the first four press stands and another printed impression applied to the other web at the next four press stands. These webs once the four printed impressions are applied to them travel at different levels, and the levels are customarily changed at deflection rollers on the diverting stand 10.

The diverting stand 10 is interposed between the last print stand 2 and a dryer 12 (FIGS. 1 & 2) which includes a lower cabinet 14, and an upper cabinet 16, each of which encloses a chamber through which heated air circulates. The two cabinets 14 and 16 at their ends have slot-like openings for enabling the web w to pass into and out of them and of course undergo a significant elevation in temperature. Indeed, the slot-like opening at the end of the lower cabinet 16 aligns with the web travel line t where it emerges from the last print stand 2, so that the web w passes into the lower cabinet 14 without and deflection of the web travel line t. The two cabinets 14 and 16 are separated slightly from each other so that a space 18 large enough to accommodate the web w exists between the two, and the web w after passing through the lower cabinet 14 returns through the space 18 and thereafter passes through the upper cabinet 16. To this end, the dryer 12 is provided with a deflecting roller 20 which aligns the return pass of the web w with the space 18, whereas the diverting stand 10 carries another deflecting roller 20 which aligns the web w with the slot that opens into the upper cabinet 16.

The printing press A also has a chill stand 22 (FIGS. 1 & 2) which carries chill rollers 24 arranged in two sets, one opposite the slot-like opening at the discharge end of the lower cabinet 14 and the other opposite the slot-like opening at the discharge end of the upper cabinet 16. The web w upon emerging from the lower cabinet 14 passes around the chill rollers 24 of the lower set and thence into the space 18 between the two cabinets 14 and 16. Upon emerging from the upper cabinet 16 the web w passes around the chill rollers 24 of the upper set. All of the chill rollers 24 are hollow, and cold water circulates through them to maintain their surfaces at a temperature lower than that of the web w as it emerges from the dryer. Thus, the rollers 24 absorb heat from the web w and thereby cool the web w.

Aside from the print stands 2, the dryer 12, and the chill stand 22, the printing press A has a coating unit C (FIGS. 1–3) which is carried by the diverting stand 10 in the small space which exists between that stand and the adjacent end of the dryer 12. The coating unit C applies a glossy coating to one surface of the web w as the return pass of the web emerges from the space 18 between the two dryer cabinets 14 and 16. At this location the ink on the web w is dry, and the web w is at a reasonably low temperature. Beyond the coating unit C, the web w passes into the upper cabinet 16 of the dryer 2 where the coating is dried and set.

The coating unit C basically includes a frame 30 and a series of cylinders and rollers which are supported on and revolve in the frame 30. Among them are upper and lower blanket cylinders 32 and 34 (FIG. 3) having rubber exterior surfaces of equal diameter. These surfaces come together at a nip which aligns with the space 18 between the upper and lower cabinets 14 and 16 of the dryer 12, and indeed the chilled web w upon emerging from that space passes into the nip. The lower blanket cylinder 34 also runs against a plate cylinder 36 having a metal cylindrical surface which is equal in diameter to the two blanket cylinders 32 and 34. The plate cylinder 36 in turn bears against an upper form roller 38 which contacts an oscillating cylinder 40 that not only turns with the form roller 38, but further oscillates to and fro in the axial direction. The oscillating cylinder 40 also contacts a lower form roller 42 which rotates adjacent to a pan roller 44. The pan roller 44 is partially immersed in a coating fluid f that is contained within a pan 46 supported on the frame 30. The pan roller 44 further runs along a metering roller 48, there being a very slight clearance between the rollers 44 and 48.

All of the cylinders 32, 34, 36, and the rollers 38 and 40 have the same surface or peripheral velocity, and well they should to avoid friction at their lines of contact. The pan roller 44 and metering roller 48 operate at a lesser surface velocity which may be varied relative to the surface velocity of the rollers and cylinders 32, 34, 36, 38, 40, and 42. Usually it is about 1/50th of the surface velocity of the rollers 32, 34, 36, 38, 40, and 42. The pan roller 44 picks up the coating fluid f from the pan 46 and moves it past the metering roller 48 where much of it is squeezed off leaving a generally uniform coating of fluid f on the pan roller 44. As the pan roller 44 continues to rotate, it brings this generally uniform coating to the lower form roller 42 to which some of it is transferred. The lower form roller 42 in turn delivers the fluid f to the oscillating cylinder 40, which by reason of its oscillation causes air bubbles within the fluid to dissipate. The oscillating cylinder 40 also spreads the fluid f to an even more uniform thickness. The oscillating roller 40 transfers the fluid f to the upper form roller 38 which in turn delivers it to the plate cylinder 36 substantially free of bubbles. The plate cylinder 36 in turn transfers the fluid f to the lower blanket cylinder 34 which brings it up to the nip between the blanket cylinders 32 and 34 and deposits it on the underside of the web w immediately after the web w emerges from the space 18 between the two drying cabinets 14 and 16. Thus, one face of the web w is covered with the coating fluid f, which upon being dried provides an attractive glossy appearance, and just as importantly, gives the web w a hard and durable finish and the extra measure of protection that derives from such a finish.

The liquid coating fluid f in the pan 46 is introduced through a supply line 50 (FIG. 3) that opens into the pan 46. The line 50 contains a valve which is under the control of an ultrasonic sensor 52 that monitors the level of the fluid f. As a result, the level remains substantially constant, and certainly deep enough at all times to cover a portion of the cylindrical surface on the pan roller 44, so that whenever the pan roller 44 revolves, it will lift the coating fluid f out of the pan 46. In this regard, the pan roller 44 revolves on bearings that are attached in a fixed position to the frame 30, so that its elevation with respect to the pan 46 remains constant. It operates independently of the rollers 32, 34 and cylinders 36 and 40, as well as the drive shaft for the press A, in that it is connected by a belt and pully drive (not shown) to a direct current motor located on the frame 30 beneath the roller 44.

While the pan roller 44 revolves about a fixed axis, the metering roller 48 turns in bearings which are attached to side plates 58 (FIG. 4) that pivot on the frame 30, so that the clearance between the metering roller 48 and the pan roller 44 may be varied. Indeed, this clearance is controlled with considerable precision by a pair of thumb screws 60 which extend through nuts on the side plates 58 and are connected to the frame 30 at their lower ends, so that they will not experience axial movement, yet will rotate. Thus, the metering roller 48 can be adjusted upwardly and downwardly by turning the thumb screws 60 and this of course varies the clearance between it and the pan roller 44. That clearance should be adjusted to about 0.020 inches.

The oscillating cylinder 40 rotates about an axis that is fixed with respect to the frame 30, and the same holds true for the plate cylinder 36 and the two blanket rollers 32 and 34. In the normal operation of the machine the axes of these cylinders and rollers is not changed. On the other hand, the two form rollers 38 and 42 are adjustable with little effort, and indeed the clearance between the second form roller 42 and the pan roller 44 may be adjusted with considerable precision. Moreover, the upper form roller 38 may be readily displaced from the plate cylinder 36, while the lower form roller 42 may be quickly separated from the pan roller 44, so that the delivery of the coating fluid to the plate cylinder 36 and lower blanket cylinder 34 may be interrupted. This interruption is usually effected during the start up of the press A, since the presence of the coating fluid f on the web w tends to cause the web w to snap when it is moving at relatively slow speeds.

The two blanket cylinders 32 and 34 and the plate cylinder 36 are all driven from the press drive shaft that extends along the various press stands 2 and supplies the power necessary to operate them, and the same holds true with regard to the oscillating cylinder 40. The form rollers 38 and 42, however, rotate merely by virtue of being in frictional contact with the oscillating roller 40.

While the oscillating cylinder 40 rotates about an axis that is for all intents and purposes fixed with respect to the frame 30, it does oscillate back and forth along its axis of rotation—hence the name oscillating cylinder 40. This oscillatory movement is derived from a mechanism of the type used to impart oscillation to certain cylinders on conventional press stands, such as the press stand 2.

Figure 7:
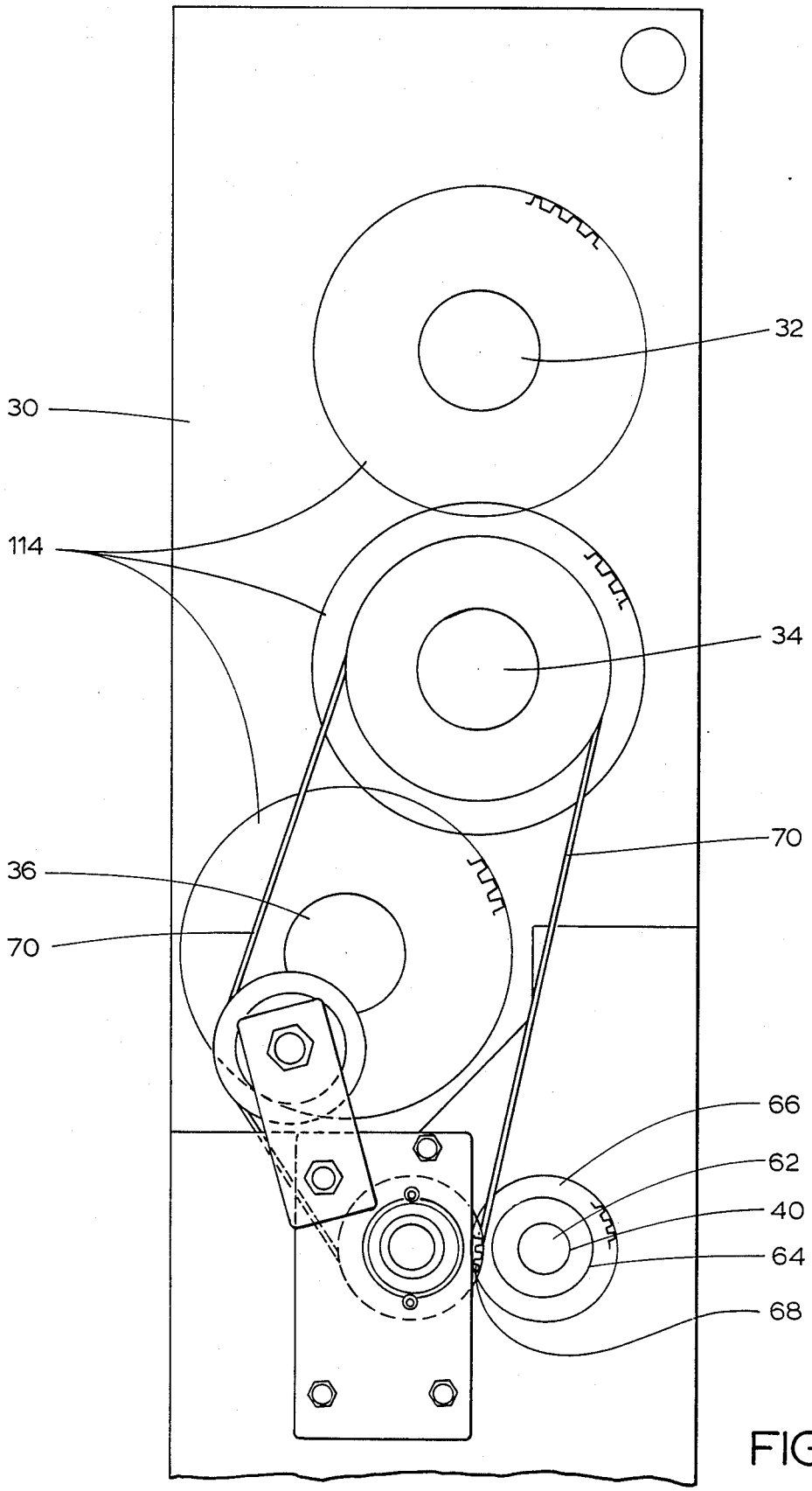
FIG. 7 is an elevational view of the printing press taken along line 7—7 of FIG. 1 and showing the drive mechanisms for the various revolving cylinders.

In order to accommodate and otherwise effect the simultaneous rotational and oscillatory motion, the oscillating cylinder 40 at its end is provided with spindles 62 (FIG. 7), and these spindles are received in brass bushings 64 that are mounted on the frame 30. Moreover, one of the spindles 62 is fitted with a gear 66 which meshes with another gear 68 that rotates on the frame 30 and is connected through a belt and pulley drive 70 to the lower blanket cylinder 34. Thus, any rotation imparted to the blanket roller 34 is transmitted to oscillating roller 40 through the belt and pulley drive 70, but the direction of rotation is reversed by reason of the meshed gears 66 and 68. One of the gears 66, 68 is somewhat wider than the other to accommodate the oscillatory movement of the cylinder 40. For example, the gear 66 which is on the spindle 62 may be 1 inch wide, while the gear 68 which drives it may be 2 $\frac{1}{8}$ inches wide. Not only do the bushings 64 serve as bearings for the oscillating cylinder 40, but they also support the two form rollers 38 and 42, although indirectly.

With regard to the upper form roller 38, the two brass bushings 64 project through eccentric collars 72 (FIG. 6) which are in turn received in bell cranks 74 (FIG. 4), the arrangement being such that the collars 72 may rotate on the bushings 64 and within the bell cranks 74 to change the position of the bell cranks 74 with respect to the common axis of the bushings 72 and oscillating cylinder 40. Each eccentric collar 72 has an upwardly directed leg and a laterally directed leg. The upwardly directed legs of the two bell cranks 74 are provided with spindles 76 (FIG. 6) which project from them into the ends of the upper form rollers 38, there being within each end of the form roller 38 a bearing 78 which receives the spindle 76 for that end. The other legs, that is the lateral legs, of the bell cranks 74 are each connected to a turnbuckle link 80 (FIGS. 4 & 5) which extends downwardly and is coupled at its lower end to an actuating arm 81 which rotates on a pivot pin 82 that is attached to the frame 30. Below its pivot pin 82 each actuating arm 81 is connected to a separate pneumatic cylinder 84 located along the inside face of the frame side. The arrangement is such that when the rods of the cylinders 84 are extended, the turnbuckle links 80 are urged upwardly and they rotate their respective bell cranks 74 generally upwardly so as to urge the upper form roller 38 snugly against the plate cylinder 36. Indeed, the rods of the pneumatic cylinders 84 move to their fully extended positions, and when in that condition, the position of the upper form roller 38 with respect to the plate cylinder 36 may be adjusted with considerable precision by rotating the turnbuckle links 80. On the other hand, when the rods of the cylinders 84 are retracted, they, acting through the arms and links 80, rotate the bell cranks 74 generally downwardly, thus withdrawing the upper form roller 38 from the plate cylinder 36.

Figure 4:
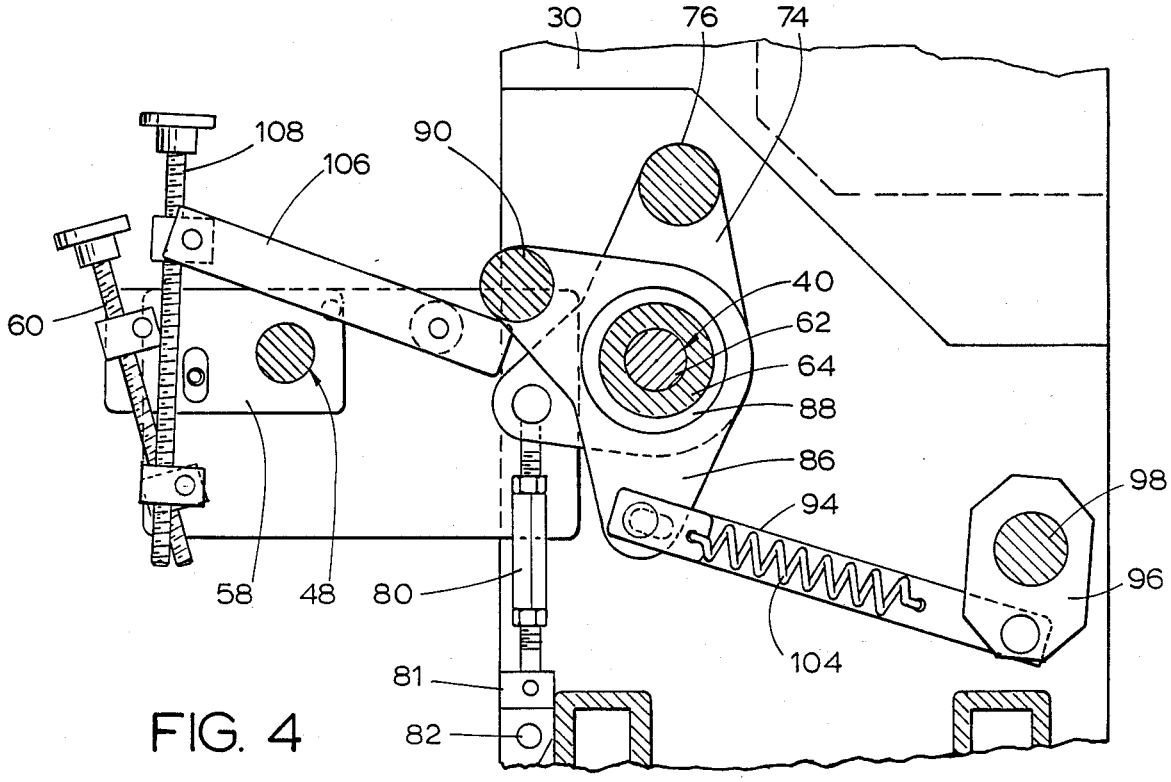
FIG. 4 is a sectional view of the coating unit taken along line 4—4 of FIG. 1 and showing the mechanisms for positioning the two form rollers as well as the metering roller.

The force with which the upper form roller 38 bears against the oscillating cylinder 40 is also controlled by rotating the eccentric collars 72 (similar to the collar 88 in FIG. 4). In this regard, each collar 72 contains several radially directed holes, at least one of which is presented rearwardly and exposed at all times. By inserting a rod into one of the exposed holes of an eccentric collar 72 a workman can rotate that collar and thereby change the position of the bell crank 74 with respect to the axis of the oscillating cylinder 40.

With regard to the lower form roller 42, it is carried on another pair of bell cranks 86 (FIGS. 4–6) which rotate on different eccentric collars 88 that fit around the brass bushings 64 for the oscillating cylinder 40. Each bell crank 86 has a laterally directed leg and a downwardly directed leg. The laterally directed legs are provided with spindles 90 which project from them into bearings 92 that ar in the ends of the lower form roller 42. The downwardly directed legs on the other hand are connected to links 94 (FIGS. 4 & 5) which extend generally transversely on the frame 30 to near the front of the frame 30 where they are connected to crank arms 96 on a cross rod 98 that extends across the frame 30 from one side to the other. The rod 98 rotates on the frame 30 and at one end is provided with another crank arm 100 which is connected to and rotated by a pneumatic cylinder 102 (FIG. 5), the opposite end of which is connected to the frame 30. The arrangement is such that when the rod of the cylinder 102 is extended, the crank arms 96 draw the links 94 forwardly and they rotate the bel cranks 86 generally downwardly. The bell cranks 86 in turn move the lower roller 42 toward the pan roller 44. On the other hand, when the rod of the cylinder 102 is retracted, it acting through the cross rod 98 and links 94 rotates the bell crank 86 generally upwardly, thus lifting the lower form roller 42 away from the pan roller 44. Actually the links 94 transmit the force exerted by the crank arms 96 directly to the bell cranks 86 only when the cylinder 102 elevates the bell cranks 86, that is when it rotates the bell crank 86 in the direction which moves the lower form roller 42 away from the pan roller 44. In the other direction, the force on each bell crank 86 is exerted through a spring 104 (FIG. 4) which forms part of the link 94 for that bell crank 86. To this end, the links 94 are connected to the bell cranks 86 so as to provide a certain amount of lost motion which renders the links 94 themselves effective when the crank arms 94 are rotated upwardly and the springs 104 effective when the bell cranks 86 are rotated downwardly.

The lower form roller 42 is normally along the pan roller 44, but does not bear forcefully against the pan roller 44. Quite to the contrary, it merely kisses or lightly touches the pan roller 44, this being necessary to effectively transfer the thin film of coating fluid f from the pan roller 44 to the form roller 42. Indeed, the clearance between the two rollers 42 and 44 must be controlled with considerable precision. This control is provided by levers 106 (FIG. 4) which pivot on the frame 30 immediately behind the bell cranks 86. The levers 106 extend forwardly beyond their pivot axes and at their front ends fit beneath the spindles 90 that project from the horizontal legs of the two bell cranks 86. Indeed, the upper edges of the levers 106 bear against the downwardly presented surfaces of the two spindles 90. The rear or trailing end of each lever 106 carries a nut through which a thumb screw 108 threads, and this thumb screw at its lower end is attached to the frame 30 such that it will rotate, but not move axially. Thus, when the two thumb screws 108 are turned in one direction, the forward ends of the levers 106 rise slightly and move the lower form roller 42 away from the pan roller 44. On the other hand, when the thumb screws 118 are turned in the opposite direction, the levers 106 descend under the force exerted by the springs 104 within the links 94, so as to reduce the clearance between the lower form roller 42 and the pan roller 44. The levers 106, being beneath the spindles 90, do not interfere with rotation of the bell cranks 86 upwardly when the cylinder 102 is energized to elevate the lower form roller 42 away from the pan roller 44 so that it does not pick up the coating fluid f.

While the thumb screws 108 and the levers 104 control the clearance between the form roller 42 and the pan roller 44, the relationship between the form roller 42 and the oscillating cylinder 40 is controlled by the eccentric collars 88 (FIG. 4) which carry the bell cranks 86. Each collar 88 contains radially directed holes, and these holes are numerous enough so that at least one is exposed at all times toward the rear. By inserting a rod into the exposed hole of a collar 88 a workman can rotate the collar 88 and thereby adjust the position of the lower form roller 42 with respect to the oscillating cylinder 40.

The plate cylinder 36 carries a plate 110 (FIG. 8) which is cylindrical in configuration and forms the exterior surface of the cylinder 36. The plate 110 has the same diameter as that of the two blanket cylinders 32 and 34, and corresponds to the typical plates used on the plate cylinders of the press stands 22, except that its exterior surface is not etched to impart a printed image to the web w. The plate 110 of the cylinder 36 acquires the coating fluid f from the upper form roller 38 and transfers it to the lower blanket roller 34 which in turn delivers it to one surface of the web w as a generally uniform coating. The plate 110, however, may be provided with a void or cutout 112 so that with each revolution of the plate cylinder 36, a small area of the web w corresponding in size and configuration to the cutout 112 is not coated. Within this area the paper of the web w is exposed, and this paper accepts ink more easily than the coating. Thus, the uncoated area may be used to apply additional printed information, such as the name and address of a magazine subscriber, perhaps by ink jet printing.

While the belt and pulley drive 70 delivers power to the oscillating cylinder 40 for rotating it, that belt and pulley drive 70 is coupled to the lower blanket cylinder 34, so that the lower blanket cylinder 34 and the oscillating cylinder 40 are directly coupled. The lower blanket cylinder 34 is also connected to the upper blanket cylinder 32 and to the plate cylinder 40 through meshed gears 114 at the ends of those cylinders, so that all three of the cylinders 32, 34 and 36 rotate in unison and at the same surface velocity. The lower blanket cylinder 34 is further connected through a right angle gear box to the press drive shaft that extends along and supplies power to the several press stands 2. The arrangement is such that the two blanket cylinders 32 and 34 and the plate cylinder 36 rotate at the same angular velocity, and since they are equal in diameter, they have the same surface velocity as well. The oscillating cylinder 40, however, is smaller in diameter, but the belt and pulley drive 70 imparts a somewhat greater angular velocity to the oscillating cylinder, to compensate for its lesser diameter, since the surface velocity of the oscillating cylinder 40 corresponds to that of the other cylinders 32, 34, and 36.

OPERATION

The web w moves through the several press stands 2 where printed images are applied to it at the blanket cylinders 4 (FIG. 2). Indeed, at each stand 2 the blanket rollers 4 apply ink of different color, so that when the web w emerges from the last stand 2 it has a full color image. Beyond the last print stand 2, the web w enters the lower cabinet 14 of the dryer 12 where volatile components of the ink evaporate so that the ink sets. After looping around the lower set of cooled rollers 24 in the chill stand 22, the web w passes into the space 18 between the two cabinets 14 and 16 of the dryer 12, and thence into coating unit C where the coating fluid f is applied to one surface of the web w. Upon emerging from the coating unit C, the web w passes over the deflecting roller 20, its opposite or uncoated surface being against that roller. The deflecting roller 20 directs the web w into the upper cabinet 16 of the dryer 12 where the volatile components of the coating fluid f are driven off so as to leave the web with a glossy protective coating. After leaving the upper cabinet 16, the web w passes around the upper set of chilled rollers 24 in the chill stand 22 where its temperature is reduced and the protective coating on its one surface becomes even harder.

Within the coating unit C, the pan roller 44 revolves such that its cylindrical exterior surfaces passes through the coating fluid f within the pan 46 (FIG. 3). Indeed, the exterior surface of the roller 44 picks up the coating fluid f and moves it up to the nip between the pan roller 46 and the metering roller 48 where the fluid is squeezed down to a more uniform thickness, the excess dropping into the pan 46. The pan roller 44 moves the coating in its more uniform character to the nip between the pan roller 44 and the lower form roller 42. In this regard, the upper cylinder 102 is in its extended condition so that the spring 104 within the transverse link 94 urges the bell cranks 86 generally downwardly and indeed causes the spindles 90 on which the form roller 42 revolves to seat against the upper surfaces of the two levers 106 (FIG. 4). Moreover, the levers 106 are adjusted with the thumb screws 108 so that the clearance between the rollers 42 and 44 enables the coating fluid f to pass onto the form roller 42 and still retain its generally uniform character. Moreover, the eccentric collars 88 are adjusted such that the lower form roller 42 bears against the oscillating cylinder 40 with just enough force to enable the oscillating roller to rotate the form roller 42 without significantly resisting the oscillatory motion of the oscillating cylinder 40. Since the roller 42 actually contacts the oscillating cylinder 40, the coating fluid f transfers from the surface of the roller 42 to the surface of the cylinder 40. At this point, the coating fluid f is likely to contain some bubbles of air, but the oscillatory movement of the cylinder 40 causes the bubbles to dissipate.

Figure 5:
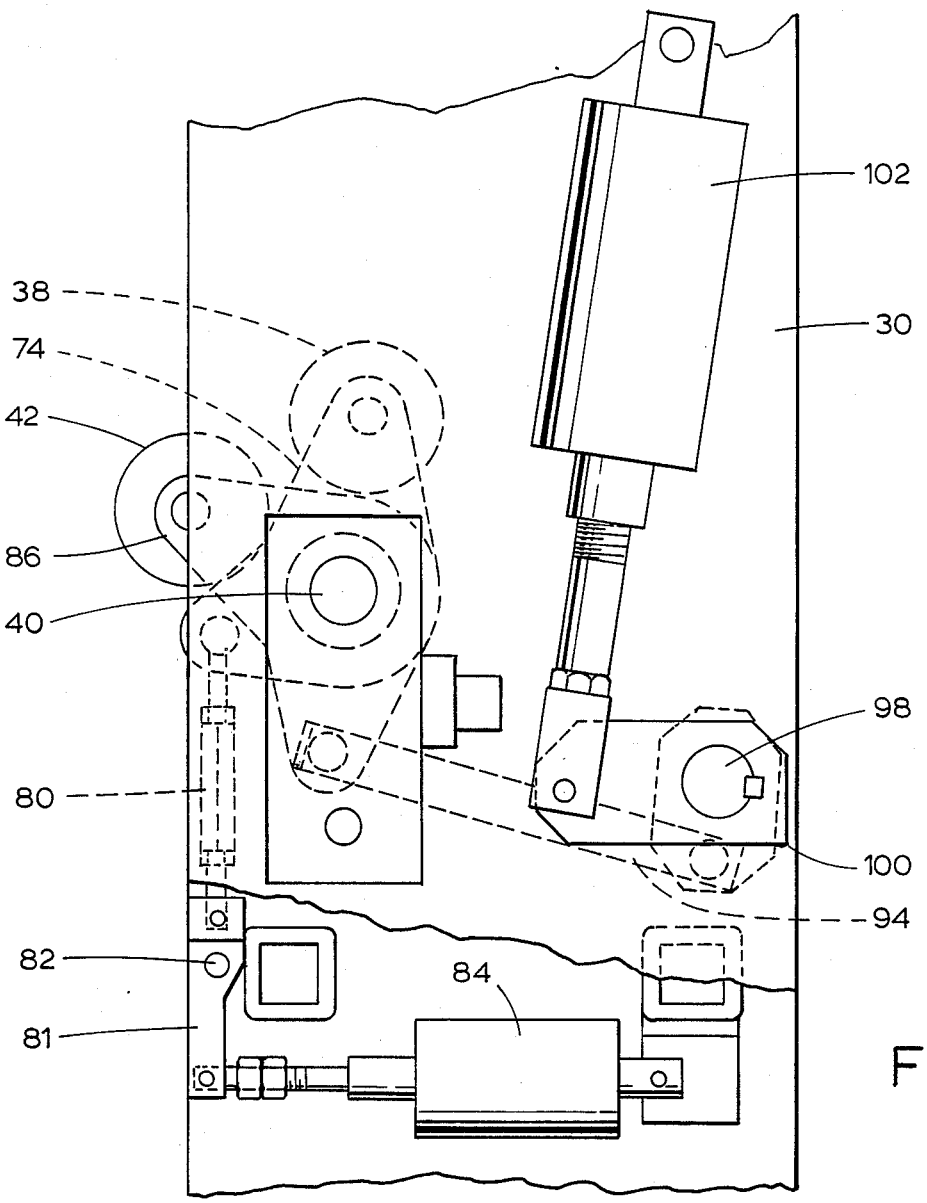
FIG. 5 is an elevational view of the coating unit taken along line 5—5 of FIG. 1 and showing the pneumatic cylinders for actuating the mechanisms that control the two form rollers.
Figure 6:
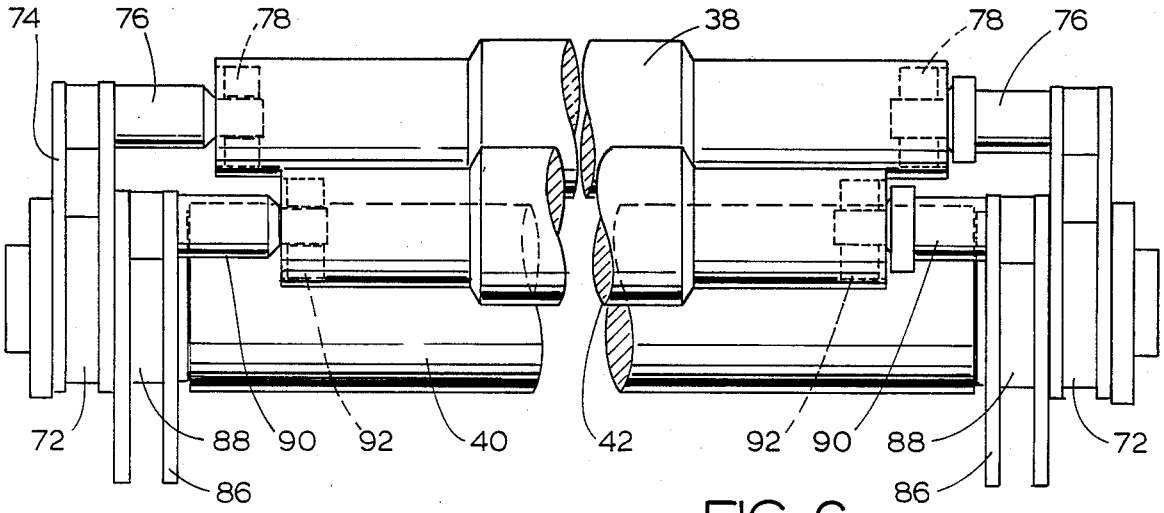
FIG. 6 is a sectional view of the coating unit taken along line 6—6 of FIG. 1 and showing the two form rollers and the oscillating cylinder as well as the supporting mechanisms for them.

Like the bell cranks 86 which carry the lower form roller 42, the bell cranks 74 (FIG. 4) which carry the upper form roller 38 are adjusted by rotating their eccentric collars 72 and turnbuckle links 80 such that the upper roller 38 likewise bear against the oscillating cylinder 40 with enough force to enable the oscillating cylinder 40 to rotate the upper roller 38, yet without significantly restraining the oscillatory motion of the cylinder 40. Moreover, the cylinders 84 are extended so as to rotate the bell cranks 74 generally upwardly and thereby cause the upper form roller 38 to bear against the plate cylinder 36 (FIG. 5).

Since the oscillating cylinder 40 contacts the upper form roller 38, the coating fluid f which is in the former flows onto the latter. Again the oscillatory motion between the cylinder 40 and roller 38 further eliminates any stray air bubbles that may exist in the fluid f, so that the coating fluid f by the time it reaches the upper form roller 38 is for all intents and purposes free of air bubbles. The upper form roller 38, being in contact with the plate cylinder 36, delivers the coating fluid f to the cylindrical exterior surface of the plate 110 that is carried by the plate cylinder 36. The fluid extends uniformly over the surface of the plate 110, and is for all intents and purposes continuous, except if the plate 110 has a cutout 112, in which case the coating fluid f is obviously interrupted at the cutout 112.

The rotating plate 110 on the plate cylinder 36 elevates the coating fluid f to the lower blanket cylinder 34 which carries it up to the web w to which it is transferred. In this regard, the plate cylinder 36 is synchronized with the blanket cylinders 4 of the several print stands 2 such that the coating on the cylindrical surface of the plate 110 for the plate cylinder 36 after being transferred through the lower blanket cylinder 34 covers the entire printed image on the web w, unless of course the plate 110 contains a cutout 112. In that event, the coating fluid f covers all of the printed web surface, except that portion which moves opposite the cutout 112. Here the paper of the web w remains exposed in the form of a "window" within the coating. This window provides a convenient location for writing or printing, for the coating f does not easily accept ink, but instead tends to repel it. Thus, when the coated web w is subsequently cut into covers for magazines, the windows in those covers provide a convenient location for subsequently applying, such as by ink jet printing, the names and addresses of the subscribers to such magazines, so that the magazines may be delivered through the mail to the subscribers.

The coating fluid f tends to cause the web w to snap when the web w moves at relatively slow speed, such as during the start up of the press A, and when the web w so moves, the cylinder 84 is retracted while the other cylinder 102 is also retracted. This drops the upper form roller 38 away from the plate cylinder 36 and elevates the lower form roller 42 off of the pan roller 44. In short, it interrupts the flow of coating fluid f available for delivery to the web w. Once the web w reaches its operating speed, the cylinder 84 is extended and the cylinder 102 extended to bring the upper form roller 38 against the plate cylinder 36 and the lower roller 42 toward the pan roller 44.

This invention is intended to cover all changes and modifications of the example of the invention herein chosen for purposes of the disclosure which do not constitute departures from the spirit and scope of the invention.

What is claimed is:

1. In combination with a printing press including at least one print stand where a printed image is applied to a web and a dryer located beyond the last print stand and including a first drying chamber through which the web passes to dry ink that is applied to it at the print stands, the improvement comprising: deflecting means for directing the web back toward the last print stand after the web passes through the dryer, and a coating unit physically interposed between the last print stand and the dryer, said coating unit comprising: first and second blanket cylinders which are located adjacent to each other so as to form a nip between them, with the nip being located such that the web passes into it after passing through the dryer and being directed back toward the last print stand by the deflecting means, a plate cylinder located adjacent to the second blanket cylinder and carrying a generally cylindrical plate which bears against the surface of the second blanket cylinder, and transfer means for applying a coating fluid to the outwardly exposed surface of the plate, whereby the coating fluid is transferred to the second blanket cylinder and thence to the web as the web passes through the nip.

2. The combination according to claim 1 wherein the plate of the plate cylinder has a cutout, so that when the plate transfers the fluid to the second blanket cylinder, a region exists on the second blanket cylinder that is free of the fluid, whereby a portion of the web is not coated with fluid.

3. The combination according to claim 1 wherein the dryer includes a second drying chamber located adjacent to the first drying chamber; and wherein the combination further comprising means for directing the web into the second drying chamber after it passes through the nip between the first and second blanket rollers of the coating unit.

4. The combination according to claim 3 wherein the second drying chamber of the dryer is located above and spaced slightly from the first drying chamber, and the means for directing the web back to the nip between the blanket cylinders of the coating unit directs the web into the space between the first and second drying chambers.

5. The combination according to claim 1 and further comprising a diverting stand located between the last print stand and the dryer and being configured to permit the web to pass through it, and wherein the coating unit is mounted adjacent to the diverting stand.

6. The combination according to claim 1 wherein the transfer means of the coating unit comprises an oscillating cylinder which rotates such that it has the same surface speed as the plate cylinder and further oscillates to and fro axially, a first form roller located between and contacting the oscillating roller and the plate of the plate cylinder; a pan for holding the coating fluid; and means for elevating the coating fluid from the pan to the oscillating cylinder.

7. The combination according to claim 6 wherein the means for elevating the fluid includes a pan roller which rotates within the pan and a second form roller that is normally along the pan roller and bears against the oscillating roller.

8. The combination according to claim 7 wherein the means for elevating the fluid further includes a metering roller which revolves close to the pan roller, yet is spaced from the pan roller, and is located such that it squeezes some coating fluid off of the pan roller before the pan roller delivers the fluid to the second form roller.

9. In combination with a succession of print stands through which a web of paper passes to have inked images applied to the web and a dryer through which the web also passes to dry the ink on the paper of the web, with the dryer being located beyond the last print stand, the improvement comprising: means for directing the web of paper back toward the last print stand after it passes through the dryer, and a machine located between the last print stand and the dryer for receiving the web and applying a coating fluid to the web after the web is directed back beyond the dryer so as to provide the paper with a protective coating, said machine comprising: a frame; upper and lower blanket cylinders mounted on the frame such that a nip exists between them for accepting the web; a plate cylinder mounted on the frame generally below the lower blanket cylinder and having a cylindrical plate that contacts the lower blanket cylinder; an oscillating cylinder mounted on the frame generally below and spaced from the plate cylinder and oscillating to and fro along its axis as it rotates; drive means for rotating the blanket, plate and oscillating cylinders such that they all have the same surface velocity; a pan for holding the coating fluid; a pan roller that rotates within the pan so that the coating fluid wets its surface; a first form roller mounted on the frame and being normally in contact with the cylindrical plate of the plate cylinder and the oscillating cylinder for transferring coating fluid from the oscillating cylinder to the cylindrical plate; and a second form roller mounted on the frame to normally rotate in close proximity to the pan roller and generally in contact with the oscillating cylinder for transferring coating fluid from the pan roller to the oscillating cylinder.

10. The combination according to claim 9 wherein the cylindrical plate of the plate cylinder is generally continuous, but contains a void so that plate cylinder will transfer the coating fluid to the blanket cylinder only in the generally continuous region thereof.

11. The combination according to claim 9 and further comprising means for moving the first form roller away from the plate cylinder.

12. The combination according to claim 9 and further comprising means for adjusting the spacing between the axis of rotation for the oscillating cylinder and the axis of rotation for the first form cylinder.

13. The combination according to claim 12 wherein the means for adjusting spacing includes bushings fitted around the ends of oscillating cylinder and having their exterior surfaces concentric to the axis of the oscillating cylinder, eccentric collars fitted around the bushings, and supports fitted around the eccentric collars and carrying the first form roller, whereby when the eccentric collars are turned, the spacing between the axes of the oscillating cylinder and first form roller will be varied.

14. The combination according to claim 13 wherein the supports are bell cranks, and further comprising means for rotating the bell cranks on the eccentric collars to separate the first form roller from the plate cylinder.

15. The combination according to claim 9 and further comprising means moving the second form roller away from the plate cylinder.

16. The combination according to claim 15 and further comprising means for adjusting the spacing between the axis of rotation for the oscillating cylinder and the axis of rotation for the second form cylinder.

17. The combination according to claim 16 wherein the means for adjusting spacing includes bushings fitted around the ends of oscillating cylinder, and having their exterior surfaces concentric to the axis of the oscillating cylinder, eccentric collars fitted around the bushings, and supports fitted around the eccentric collars and carrying the second form roller, whereby when the eccentric collars are turned, the spacing between the axes of the oscillating cylinder and second form roller will be varied.

18. The combination according to claim 17 wherein the supports are bell cranks, and further comprising means for rotating the bell cranks on the eccentric collars to separate the first form roller from the plate cylinder.

19. The combination according to claim 9 and further comprising a metering roller located adjacent to the pan roller for removing some coating fluid from a surface area of the pan roller before that surface area moves on to the second form roller where some of the coating fluid is transferred to the second form roller.

20. The combination according to claim 19 and further comprising means for moving the first form roller away from the plate cylinder and means for moving the second form roller away from the pan roller.

21. In combination with at least one print stand at which a printed image is applied to a web and a dryer located beyond the print stand in the path taken by the web and having a heated interior through which the web passes to dry the ink that is applied to it, the improvement comprising: first directing means for directing the web, after it passes through the heated interior of the dryer, back generally toward the print stand, and a coating unit generally interposed between the print stand and the dryer for receiving the web after it is directed back toward the print stand and applying a coating fluid to the web, the coating unit including a blanket roller over which the web passes with the roller revolving as the web moves over it and means for supplying the coating fluid to the blanket roller remote from the web so that the blanket roller will transfer the fluid to the web as the blanket roller revolves.

22. The combination according to claim 21 wherein the coating unit includes a second blanket roller which revolves with the first blanket roller and forms with the first blanket roller a nip through which the web passes.

23. The combination according to claim 21 and further comprising second directing means located downstream from the coating unit for directing the web, after it passes through the coating unit, back into the heated interior of the dryer.

24. The combination according to claim 23 wherein the dryer has first and second chambers arranged adjacent to each other and with a space between the two chambers, wherein the web between the print stand and the first directing means passes through the first chamber, wherein the web between the first directing means and the coating unit passes through the space, and wherein the web after the coating unit passes through the second chamber.

* * * * *